United States Patent [19]

Davis

[11] Patent Number: 4,722,160

[45] Date of Patent: Feb. 2, 1988

[54] COMBINATION GRAVE MARKER AND FLOWER RECEPTACLE

[76] Inventor: Charles R. Davis, 1026 Appletree La., Erie, Pa. 16509

[21] Appl. No.: 896,644

[22] Filed: Aug. 15, 1986

[51] Int. Cl.[4] ..... A01G 5/00

[52] U.S. Cl. ..... 47/41.1; 47/41 R

[58] Field of Search ..... 47/41.1, 41.11, 41; 248/364, 292.1; 16/1 C, 360; 49/387; 220/18

[56] References Cited

U.S. PATENT DOCUMENTS

| | | | |
|---|---|---|---|
| 476,739 | 6/1892 | Flaherty | 248/292.1 |
| 1,523,223 | 1/1925 | Leonardos | 248/364 |
| 2,608,028 | 8/1952 | Ross | 47/41.1 |
| 3,541,727 | 11/1970 | Carlson | 47/41.1 |
| 4,467,932 | 8/1984 | Dabich | 220/18 |

*Primary Examiner*—Robert A. Hafer
*Assistant Examiner*—Bradley M. Lewis
*Attorney, Agent, or Firm*—Charles L. Lovercheck; Wayne L. Lovercheck; Dale R. Lovercheck

[57] ABSTRACT

A combination grave marker and vase is disclosed. The marker has an enclosure with a top, bottom and four sides. The top has an opening closed by a swinging cover. The cover has a lever with a counterweight. The lever also has an arcuate slot which registers with a slotted member extending generally vertically. An axle on the counterweight engages both the slot in the lever and enclosure. The cover has a receptacle for flowers. When the marker is in use, the cover is opened which will be moved to use position and the flowers can then be placed in the flower receptacle. Since the flower receptacle is integral with the cover, it cannot be cra-ried away and lost. The enclosure top can be flush with the surface of the ground so that it does not interfere with normal cemetery maintenance.

11 Claims, 5 Drawing Figures

COMBINATION GRAVE MARKER AND FLOWER RECEPTACLE

BACKGROUND OF THE INVENTION

There is a trend in grave markers to make them flush with the ground so that a groundskeeper can work over and around them without inconvenience.

Containers for flowers present a problem in that they obstruct lawnmowers and other equipment and otherwise interfere with cemetery care. They are subject to pilfering and may not be neat in appearance. Vandals are inclined to disturb or remove the vases and to carry them away leaving an unsightly space.

STATEMENT OF THE INVENTION

I have discovered that by making a grave marker in the form of a container with a cover and a flower receptacle integral with the cover of the grave marker that the cover can be closed and the flower receptacle can be concealed when not in use. The marker will be flush with the surface of the ground out of the way of lawn mowers and can be swung to the open position at any time to expose the flower container for use. By providing a proper counterweight arrangement for the cover, the cover can easily be opened and will be automatically held in an open position and can be easily closed and automatically held in closed position with little or no effort and no inconvenience.

The counterweight will be minimumly influenced by time (i.e. there are few moving parts and nothing to rust or wear out.

The system disclosed allows even the frailest of persons to deploy the marker regardless of the unit's size or weight. Once deployed, the weight distribution of the counter weight loads the marker in the upright position. Once reclined, the weight distribution loads the marker in the down position so there is no danger that the unit could accidentally deploy during ground's keeping. The ground keeping personnel need only remove the flowers from the vase and step on the upright marker to recline the unit, unlike the more cumbersome repositioning of the current vase system. This alone can result in many man hours saved in ground keeping.

OBJECTS OF THE INVENTION

It is an object of the invention to provide an improved receptacle for cemetery flowers.

Another object of the invention is to provide an improved grave marker.

Another object of the invention is to provide an improved combination grave marker and flower receptacle which is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWINGS

Figure 1:
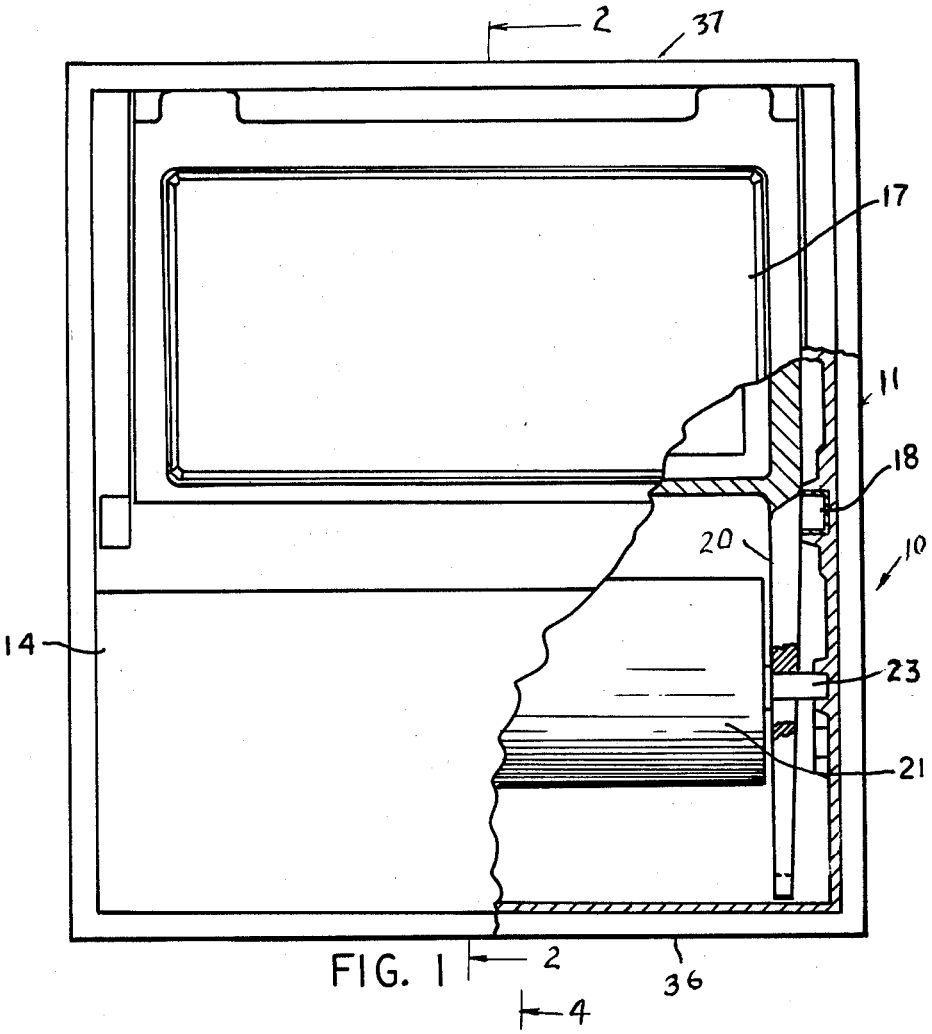
FIG. 1 is a top view, partly in cross section, taken on line 1—1 of FIG. 2, of the marker according to the invention.
Figure 2:
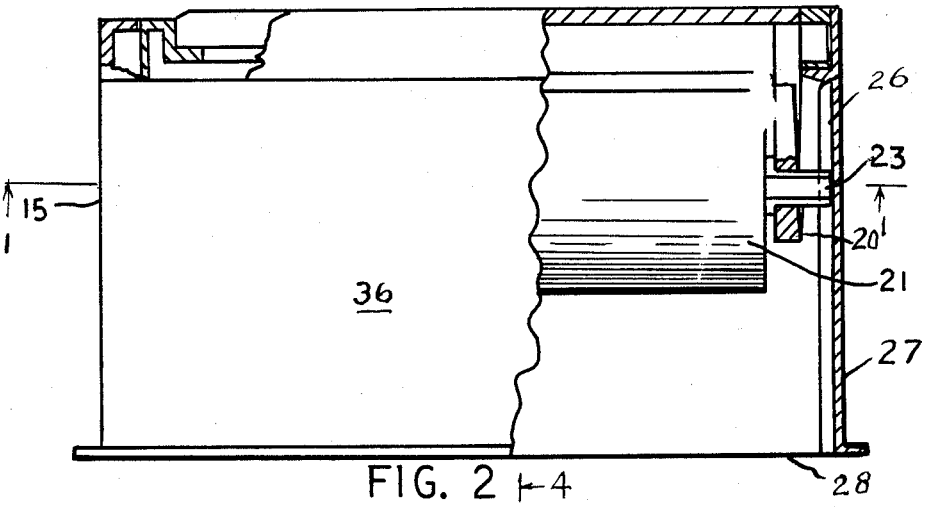
FIG. 2 is an end view partly in cross section, taken on line 2—2 of FIG. 4.

Now with more particular reference to the drawings, I show a combination grave marker and flower holder indicated generally at 10 comprising an enclosure 11 adapted to be embedded in the ground with the top part 16' flush with the top of the ground 12 so as not to interfere with maintenance of the cemetery. Marker 10 may be situated adjacent to or over a grave. The enclosure 11 has at least a top 14, bottom 28, sides 15 and ends 36 and 37. An opening 16 in the top part 16' is provided. The opening 16 is closed by a cover 17. Cover 17 is hinged to the top 14 of the enclosure at pivot 18.

Spaced wing supports 31 are integrally attached to the cover 17 and integrally connected together by arcuate wing 35. The flower receptacle 19 is integrally attached to the periphery of an opening in wing supports 31 and extends downward between the cover 17 and the arcuate wing 35.

Figure 4:
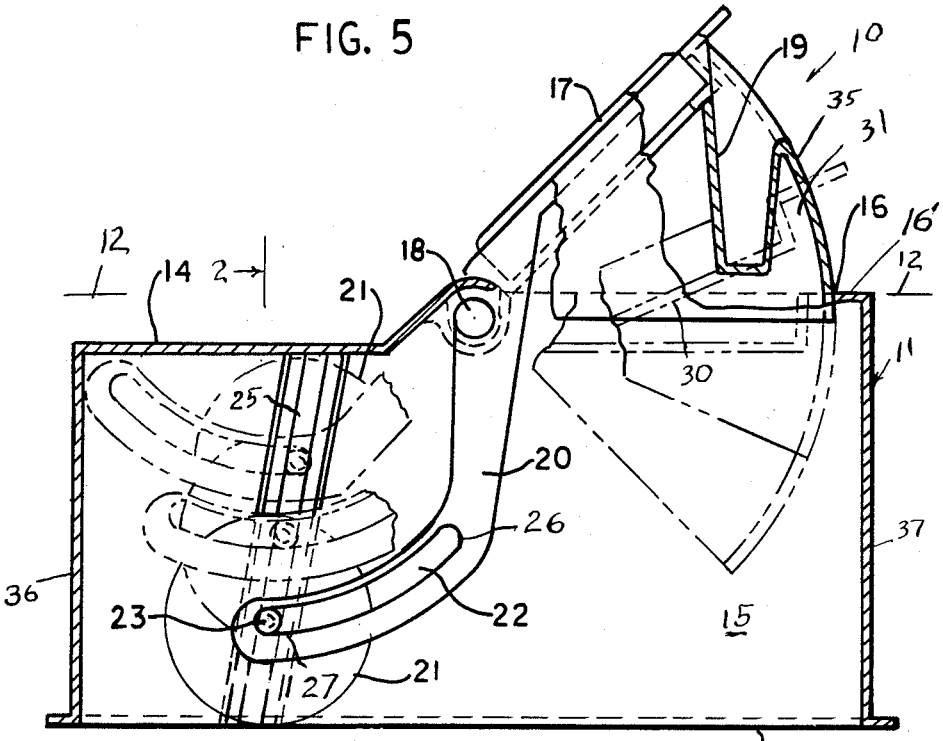
FIG. 4 is a cross sectional view of the marker taken on line 4—4 of FIG. 2.

The cover 17 is swingable from an open position shown in full lines in FIG. 4 to a partly closed position and to a fully closed position shown in phantom lines in FIG. 4. Two spaced levers 20 are integrally attached to cover 17 and extend therefrom. A counterweight 21 in the form of a cylindrical drum is supported on the cover 17 by means of levers 20 through axle 23 which is slidably received in the first slot 22 which is formed in lever 20. The counterweight 21 may be hollow and filled or partly filled with sand or other heavy material. A second slot 25 is provided on the sides 15 of the enclosure 11. The axle 23 extends laterally from the first slot 22 in the lever 20 to the second slot 25 on the enclosure 11 so that axle 23 is guided up and down in a vertical path by the second slot 25. Second slot 25 acts as a guide means. The counterweight 21 therefore moves up and down from the position shown in full lines to positions shown in phantom lines to correspond to the vertical movement of the cover 17.

The first slot 22 has a first end 26 and a second end 27. The axle 23 is located at the first end 26 of first slot 22 when the cover 17 is closed. The axle 23 moves to second end 27 of the slot 22 when the cover 17 is open. The counterweight 21 will move in a linear motion up and down following second slot 25. The mechanical advantage of counterweight 21 changes its position on levers 20 to compensate for the change of position of the center of gravity around pivot 18 so that the cover 17 will remain balanced in any position to which it is moved. The first slot 22 and the second slot 25 are so arranged that the counterweight 21 moves in a path generally parallel to the path of the center of gravity of the cover.

Figure 5:
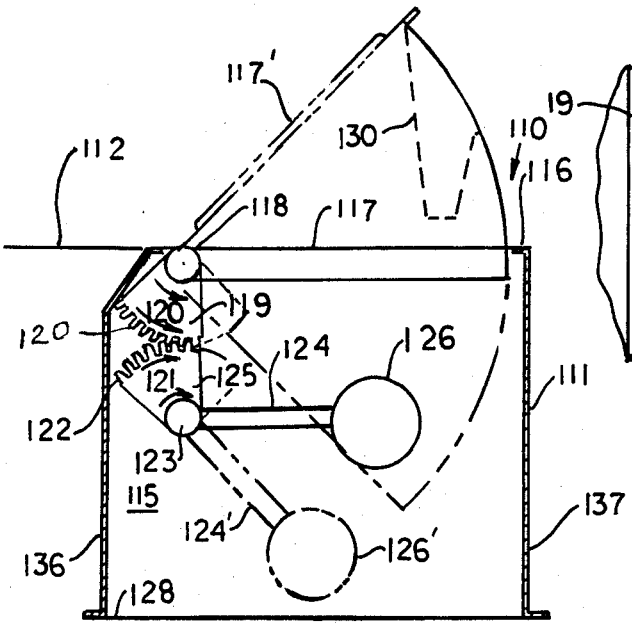
FIG. 5 is a cross sectional view similar to FIG. 4 of another embodiment of the marker.
Figure 3:
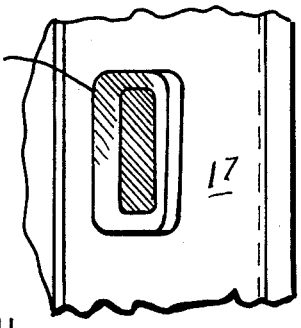
FIG. 3 is a partial top view of the marker.

In the embodiment of the invention shown in FIG. 5, I show a combination grave marker and flower holder indicated generally at 110 comprising an enclosure 111 adapted to be embedded in the ground 112 with the top 116 flush with the top of the ground 112 so as not to interfere with maintenance of the cemetary such as the operation of lawn mowers and the like.

Marker 110 may be situated adjacent to or over a grave. The enclosure 111 has at least a top 116, bottom 128, sides 115 and ends 136 and 137. An opening is provided in top 116. The opening is closed by cover 117. Cover 117 is hinged to top 116 by a pivot member 118 attaching cover 117 to the enclosure 111.

A gear sector 119 is fixed to the pivot member 118. Gear sector 119 has an arcuate body 120 and gear teeth 120' which mesh with gear teeth 122 on gear sector 125. Gear sector 125 has an arcuate body 121 and is fixed to the pivot member 123 which is also pivoted to enclosure 111. Lever 124 is fixed to sector 125. A weight 126 is fixed to the outer end of lever 124. Thus when the cover 117 is in the closed position as shown in phantom lines, the weight 126 is in the phantom line position. The gears will be in the position shown in full line position when the cover is swung to the open full line position, the weight 126' moves to the full line position shown. It will be noted that when the weight is in position 126', the cover 117 is in the position 117', or open, and the full weight of the weight 126 is exerted on the sector 125 transmitted to gear sector 119 and thereby to the pivot member 118.

When the cover 117 is open to expose the flower receptacle 130, the weight 126 will be swung to the position 126' so that the weight 126 will urge the cover 117 to stay open. When the cover 117 is closed, the weight 126 will be raised and hold the cover closed. When the cover 117 is open the gear sectors will be in the opposite position shown.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a grave marker and flower receptacle comprising an enclosure adapted to be embedded in the ground adjacent a grave, said enclosure having at least a top and spaced sides, an opening in said top and a cover, pivot means swingably connecting said cover to said enclosure adjacent said opening, whereby said cover is swingable from an open position to a closed position, a receptacle for flowers integrally attached to said cover and extending downwardly therefrom at a position spaced longitudinally from said pivot means whereby the weight of said receptacle exerts a torsional force on said cover around said pivot means in a first direction, a lever attaching means attaching said lever to said cover and extending therefrom, a counterweight adapted to counterbalance said cover torsional force, slot means comprising a first slot in said lever, a second slot in said enclosure, an axle on said counterweight extending laterally therefrom, said first slot and said second slot being disposed in intersecting relation to each other, said axle being received in said first slot and in said second slot and being movable in said slots when said cover is moved between open and closed position whereby said counterweight is guided in a path generally parallel to said path of the center of gravity of the cover and said flower receptacle to hold said cover in an open or in a closed position.

2. The combination recited in claim 1 wherein said counterweight engaging said first and said second slots comprises an axle extending through said first slot and engaging said second slot on said enclosure whereby said counterweight moves through a pre-determined, generally vertical, path when said cover is opened and closed.

3. The combination recited in claim 2 wherein said enclosure top when in closed position is supported flush with the top surface of the ground.

4. The combination recited in claim 3 wherein said first slot is arcuate and having a first end disposed at a position adjacent the lower end of said second slot means when said cover is open and a second end adjacent the upper end of said second slot means when said cover is in closed positon.

5. The combination recited in claim 2 wherein said counterweight is cylindrical in shape and has said axle extending from each end of said counterweight.

6. The combination recited in claim 1 wherein a second lever is fixed to said cover, spaced from said first mentioned lever, said second lever has a slot therein extending longitudinally thereof parallel to said first mentioned slot, said axle extends from each side of said counterweight and is received in said first slots with said counterweight being disposed between said levers.

7. The combination recited in claim 6 wherein said enclosure has two spaced said second slot in said spaced sides, said axle engages said spaced second slot guiding said axle in a generally vertical path.

8. The combination recited in claim 1 wherein said counterweight is cylindrical in shape, said axle is disposed at the central longitudinal axis of said counterweight.

9. The combination recited in claim 8 wherein said counterweight is hollow.

10. The combination recited in claim 9 wherein said lever has a first part fixed to said cover and extending downward and from said cover, then extending generally parallel to said cover and curving upward, said slot in each said lever is disposed in said curved parts of said lever whereby said cover is balanced by said lever in a central position of said cover and loaded toward open position when said cover in the open position and loaded toward closed position when said cover is in the closed position thereby preventing said cover from vibrating open when disturbed by a lawn mower or the like.

11. The combination recited in claim 10 wherein said flower receptacle extends beyond an end of said cover when said cover is in the open position.

* * * * *